US006646193B1

(12) United States Patent
Ball

(10) Patent No.: US 6,646,193 B1
(45) Date of Patent: Nov. 11, 2003

(54) EASY INSTALL MUSICAL INSTRUMENT STRING SYSTEM

(75) Inventor: James E. Ball, 153 Ball Branch, Pinsonfork, KY (US) 41555

(73) Assignee: James E. Ball, Pinsonfork, KY (US)

( * ) Notice: Subject to any disclaimer, the term of this patent is extended or adjusted under 35 U.S.C. 154(b) by 0 days.

(21) Appl. No.: 10/175,828

(22) Filed: Jun. 21, 2002

Related U.S. Application Data

(60) Provisional application No. 60/375,082, filed on Apr. 25, 2002.

(51) Int. Cl.[7] ..... G10G 7/02
(52) U.S. Cl. ..... 84/453; 84/297 R
(58) Field of Search ..... 84/453, 297 R, 84/297 S

(56) References Cited

U.S. PATENT DOCUMENTS 3,731,793 A 5/1973 Hagel
4,377,963 A 3/1983 Siminoff
4,852,447 A 8/1989 St. Denis
4,909,122 A * 3/1990 Franke et al. ..... 84/329
5,372,057 A 12/1994 Hart
6,489,548 B1 * 12/2002 Schindler ..... 84/453

* cited by examiner

*Primary Examiner*—Kimberly Lockett
(74) *Attorney, Agent, or Firm*—John Remon Wenzel; Richard C. Litman; Dolph H. Torrence

(57) ABSTRACT

An easy install musical instrument string system having a substantially rectangular holder strip with a front surface, a back surface, a top end and a bottom end. A plurality of channels are defined in the front surface of the holder strip running from the top end to the bottom end of the strip. Musical instrument strings are disposed in each channel in the order the strings would be attached to the particular instrument for which the strings are adapted. A sheet covers the strings and the front surface of the strip and attaches to the back surface of the strip. The ends of the strings extend past the ends of the holder strip far enough to be attachable to the head and body of a particular stringed musical instrument.

9 Claims, 6 Drawing Sheets

EASY INSTALL MUSICAL INSTRUMENT STRING SYSTEM

CROSS-REFERENCE TO RELATED APPLICATION

This application claims the benefit of U.S. Provisional Patent Application Ser. No. 60/375,082 filed on Apr. 25, 2002.

BACKGROUND OF THE INVENTION

1. Field of the Invention

The present invention relates generally to musical instrument strings, and more specifically to a musical instrument string holding device that facilitates the changing of the instrument's strings as a unit.

2. Description of Related Art

The strings of most stringed musical instruments wear with time and use, and must be replaced periodically. Unfortunately, changing an instrument's strings is often a time consuming, hassle-filled endeavor. For example, to string a guitar one must attach each string to the guitar bridge or tail piece, run it up the fret board, insert it into the proper tuning peg, then wind and tune each string. Further time is added to this process because guitar strings are often sold coiled in groups in small plastic bags. Strings often get tangled, and it can be difficult to tell what string belongs in which position on the guitar. Coiled guitar strings can also be under great tension which can cause them to straighten unexpectedly at high speed when uncoiled. This unexpected uncoiling can be a painful, even dangerous experience.

Past attempts to rectify this problem include the teachings of U.S. Pat. No. 3,731,793 to Hagel, which shows a package comprising two thin sheets sealed to one another with a circular cavity formed therein between. The Hagel patent teachings are different because the present invention holds instrument strings in the order they are played, and even when the device is coiled the strings will not become tangled.

U.S. Pats. No. 4,377,963 to Siminoff and 4,852,447 to St. Dennis disclose spools having a guitar string wound thereon. The free end of the string is attached to the bridge or tailpiece of the guitar and the string is uncoiled from the spool up to the guitar head piece. There the spool is attached to a tuning peg. These teachings are different from the present invention in that unlike the present invention both require the user to individually select the proper position for each string and line up each string on the guitar. The present invention also does not require the spool device present in the '963 and '447 inventions.

U.S. Pat. No. 5,372,057 to Hart discloses a string attachment means for musical instrument strings, consisting of a pin that is attached to one end of the string and is inserted into and individual tuner peg. The '057 invention does not disclose a means by which the strings may be lined up to their proper positions without the need of physically running each string up the fret board. The '057 invention could, however, be used with the present invention for added convenience.

None of the above inventions and patents, taken either singly or in combination, is seen to describe the instant invention as claimed.

SUMMARY OF THE INVENTION

The present invention is designed to simplify the replacement of almost any stringed musical instrument with a head, neck and body. The invention has a rectangular holder strip with a front surface, back surface, a top end and a bottom end. The strip is approximately as wide as the intended instrument's neck and as long as the distance between the instrument's bridge and the nut of a particular instrument. A plurality of channels extend lengthwise along the top side of the strip. In the case of a six-string guitar, six strings are ordinarily placed in the channels in the order they are strung on the guitar. A sheet of packaging material is placed over the strings and is secured to the strip. The ball ends and tuning peg ends of the strings protrude from the bottom and top ends of the strip, respectively. The invention may also incorporate a group of interconnected sheaths to secure the tuning peg ends of the strings until attachment to an instrument.

When in use the strip is laid against the fret board of a guitar. The protruding ball ends of the strings are inserted into. the bridge or tailpiece and the protruding peg ends of the stings are removed from their sheaths and wound around the appropriate tuning pegs. Once the strings are so wound, the sheet is removed and the holder strip is pulled free, leaving a fully strung musical instrument.

Accordingly, it is a principal object of the invention to provide a novel way to package and sell a complete set of strings, whereby the package itself allows the instrument to be strung more quickly and easily than is currently possible.

It is another object of the invention to provide a device that holds several musical instrument strings, in playing order, without tangling.

It is a further object of the invention to provide a device which can hold musical strings in a straight rather than a coiled orientation.

It is still a further object of this invention to provide a device that can securely store musical instrument strings without damaging the strings when they are removed from the device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
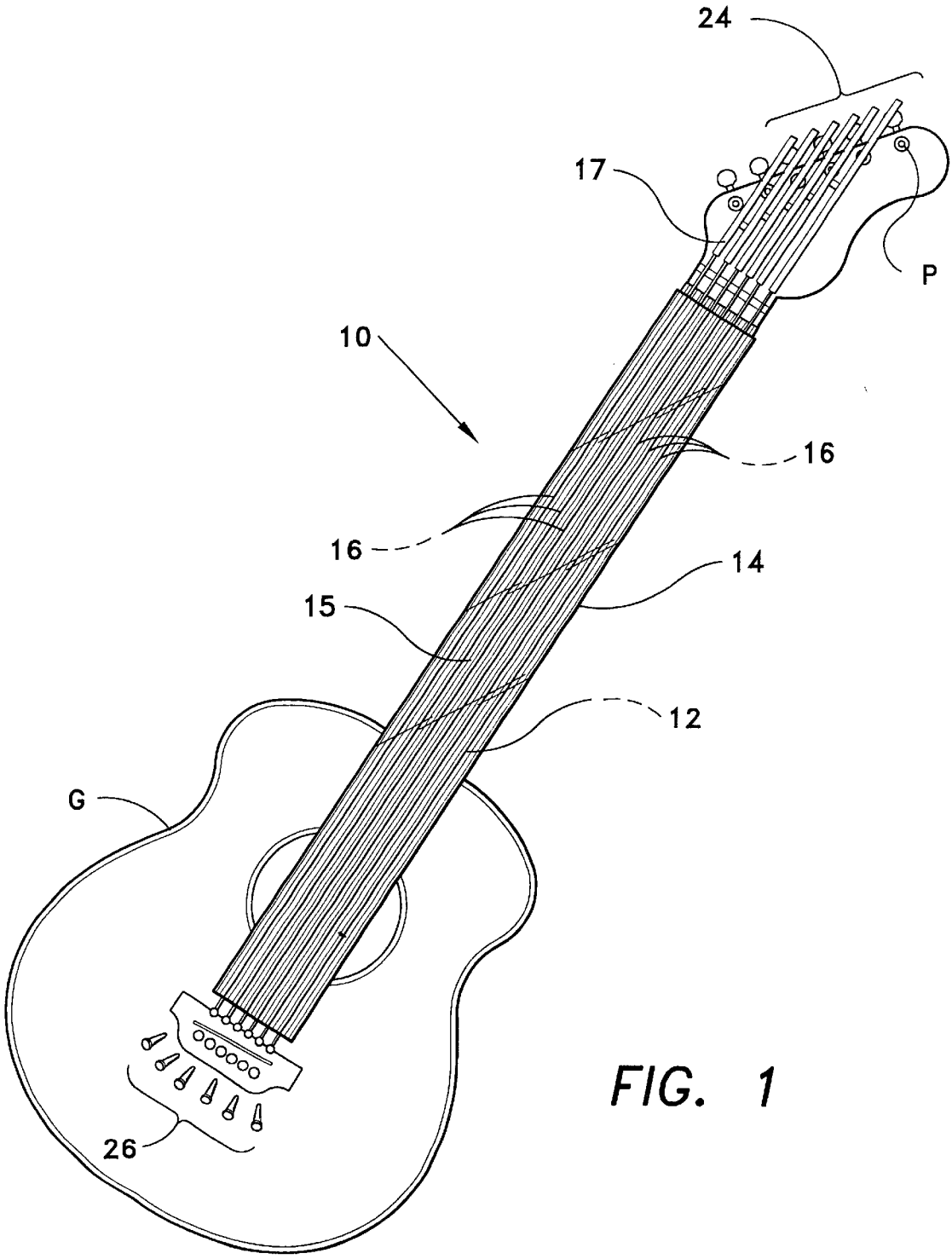
FIG. 1 is an environmental, perspective view of a easy install musical instrument string system being used to attach strings to a guitar according to the present invention.

FIG. 1 shows the easy install musical instrument string system 10 as it is used to attach guitar strings 12 to a conventional, six-string guitar G. The following discussion details the invention as adapted for guitars. However, one skilled in the art would be able to easily adapt the invention to work with almost any stringed instrument with a head, neck and body.

The invention has a preferably rectangular holder strip 14 with a front surface, back surface, a top end and a bottom end. The holder strip may be made from plastic, cardboard, paper or any other material suitable for storing musical instrument strings. A plurality of channels 16 are defined in the front surface of the holder strip 14 and run from the top end of the strip 14 to the bottom end. Many different channel designs may be used and are discussed further below. Guitar strings 12 are positioned one in each channel in the order that they would be strung and played on the guitar. A sheet 15 (discussed below) is sealed over top of the strings and the front surface of the strip 14, and is preferably secured to the back surface of the holder strip 14. The sheet 15 may also be secured to the front or side surfaces of the strip 14. The sheet 15 may be made of plastic, paper or other similar material suitable for packaging musical instrument strings and may, be perforated lengthwise for easy removal.

The strings 12 have two ends, peg end 24 and ball end 26, which protrude from the top and bottom ends respectively of the holder strip 14. The peg ends 24 protrude more than the ball ends 26 from the strip 14 to accommodate the winding of the peg ends around guitar tuning pegs P.

Figure 2A:
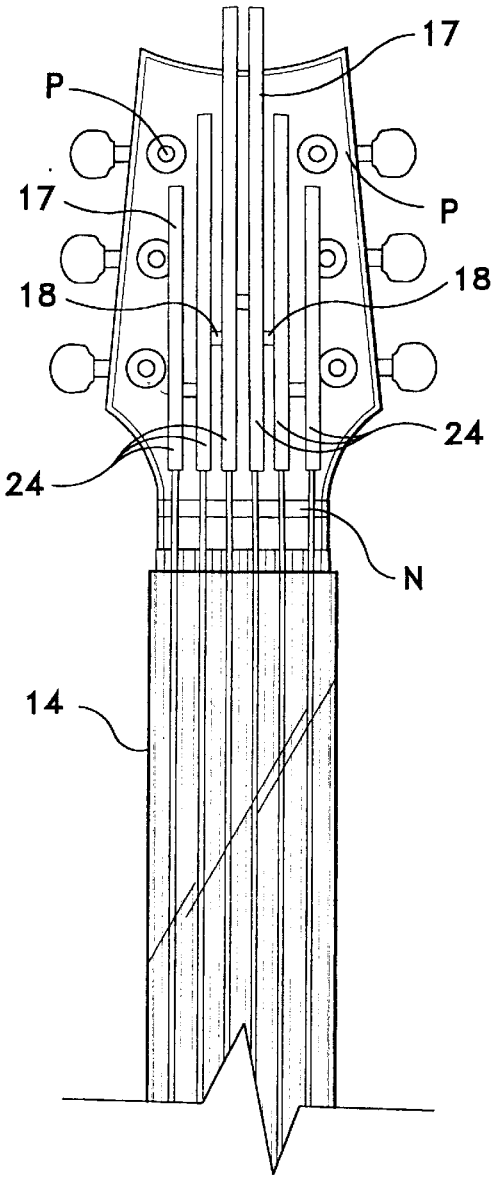
FIG. 2A is a top view of the sheaths used to secure the peg ends of the instrument strings.
Figure 2B:
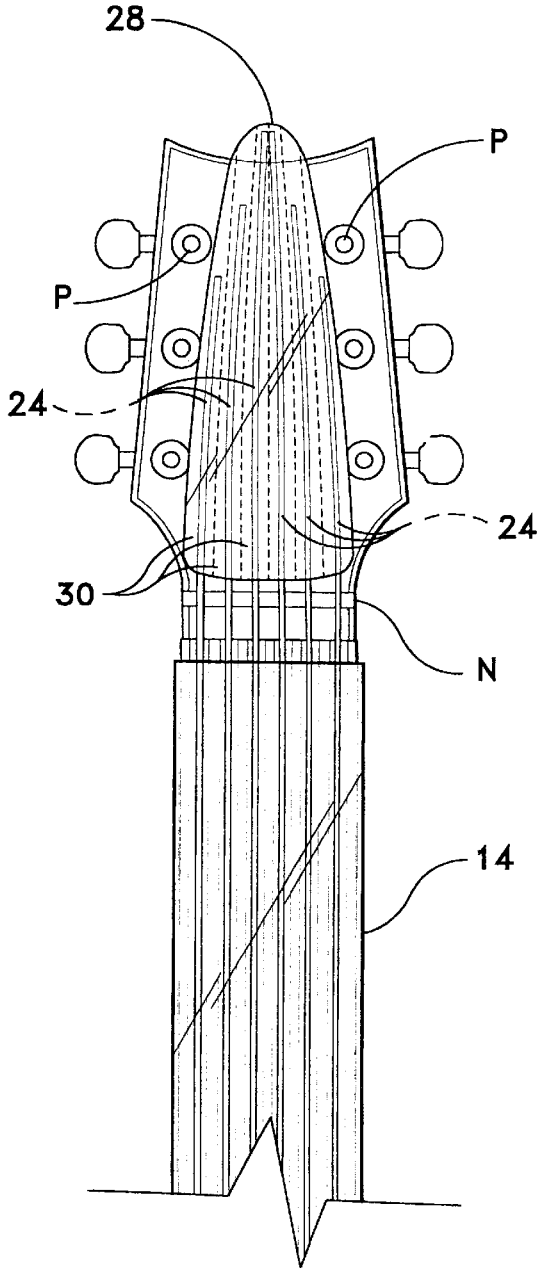
FIG. 2B is a top view of the head strip used to secure the peg ends of the instrument strings.

FIGS. 2A and 2B show two devices for securing and preventing tangling of the peg ends 24. The first, as shown in FIGS. 1 and 2A, involves inserting each peg end 24 into a sheath 17. The sheaths 17 will prevent unwanted motion by the peg ends 24 and may themselves be secured together with tabs 18. The tabs 18 are designed to break when the sheath 17 is removed during installation of the string 12. It will be seen in FIGS. 1 and 2A that the length of each sheath 17 varies according to the length of the portion of the string 12 encased in the sheath 17.

FIG. 2B details a second way of securing the peg ends 24. A head strip 28 having a front surface, back surface, a top end and a bottom end is used to contain the peg ends 24 of the guitar string. The head strip 28 is essentially triangular in shape and is dimensioned to fit inside the tuning pegs P on the guitar head. The head strip has a plurality of channels 30, similar in structure to the channels 16 defined in holder strip 14 (discussed below), defined in its front surface. These channels 30 curve toward one another so as to fit the contours of the head strip 28. There is sufficient space between the bottom end of the head strip 28 and the top of the holder strip 14 to allow for the placement of a guitar nut N therebetween. One skilled in the art will be able to alter the size and/or shape of the head strip 28, the sheaths 17, and the associated peg ends 24 to conform with the necessary length and space limitations of a particular musical instrument head.

Figure 3A:
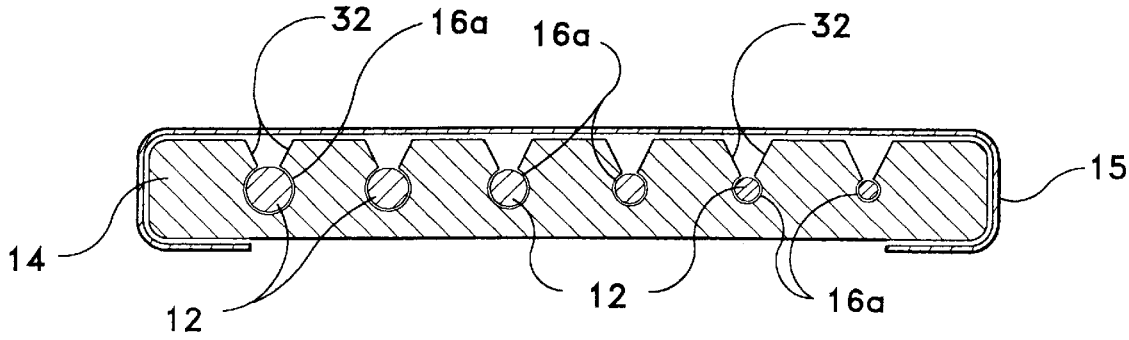
FIG. 3A is a sectional view of a first type of channels used to secure instrument strings in the holder strip.
Figure 3B:
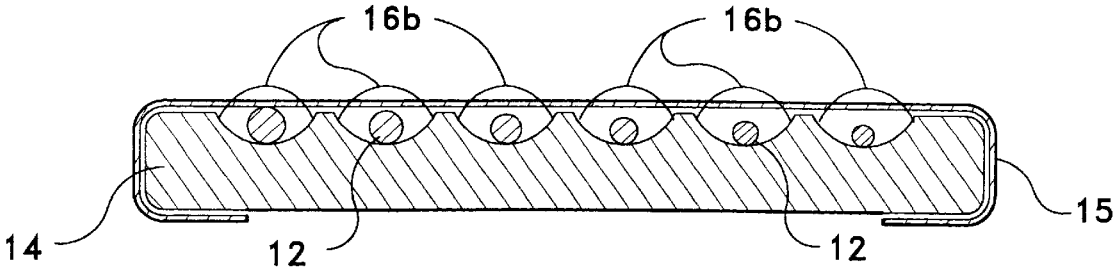
FIG. 3B is a sectional view of a second type of channels used to secure instrument strings in the holder strip.

FIGS. 3A and 3B are cross-sectional views of the channels 16*a*, 16*b* which may be defined in the front surfaces of the holder strip 14. An aforementioned channel 16 illustrated in FIG. 1 may be either type of channel 16*a*, 16*b*. If a head strip 28 is used, it, will ordinarily have the same type of channels as the associated holder strip 14. The channels 16*a* in FIG. 2A differ in diameter depending on the diameter of the string 12 to be inserted therein such that each string 12 will be held with enough friction to prevent the strings from sliding laterally in the direction of the top or bottom ends of the holder strip 14 when the holder strip is stored vertically (e.g., as on a display in a music store). The material of each strip protrudes inwardly above each channel 16 so as to form an overhang 32 which further secures the strings 12. The channels 16 must allow each string 12 to be removed without bending or otherwise damaging the strings 12. A sheet 15 overlies the holder strip 14 and further protects the strings 12.

FIG. 3B details a second type of channel 16*b* that is designed to separate the strings but not to hold them in position as in the case of the channels 16*a*. These channels 16*b* are semicircular depressions in the associated strips 12, 28. A sheet 15 overlies the holder strip 14 and protects and secures the strings 12.

Figure 4A:
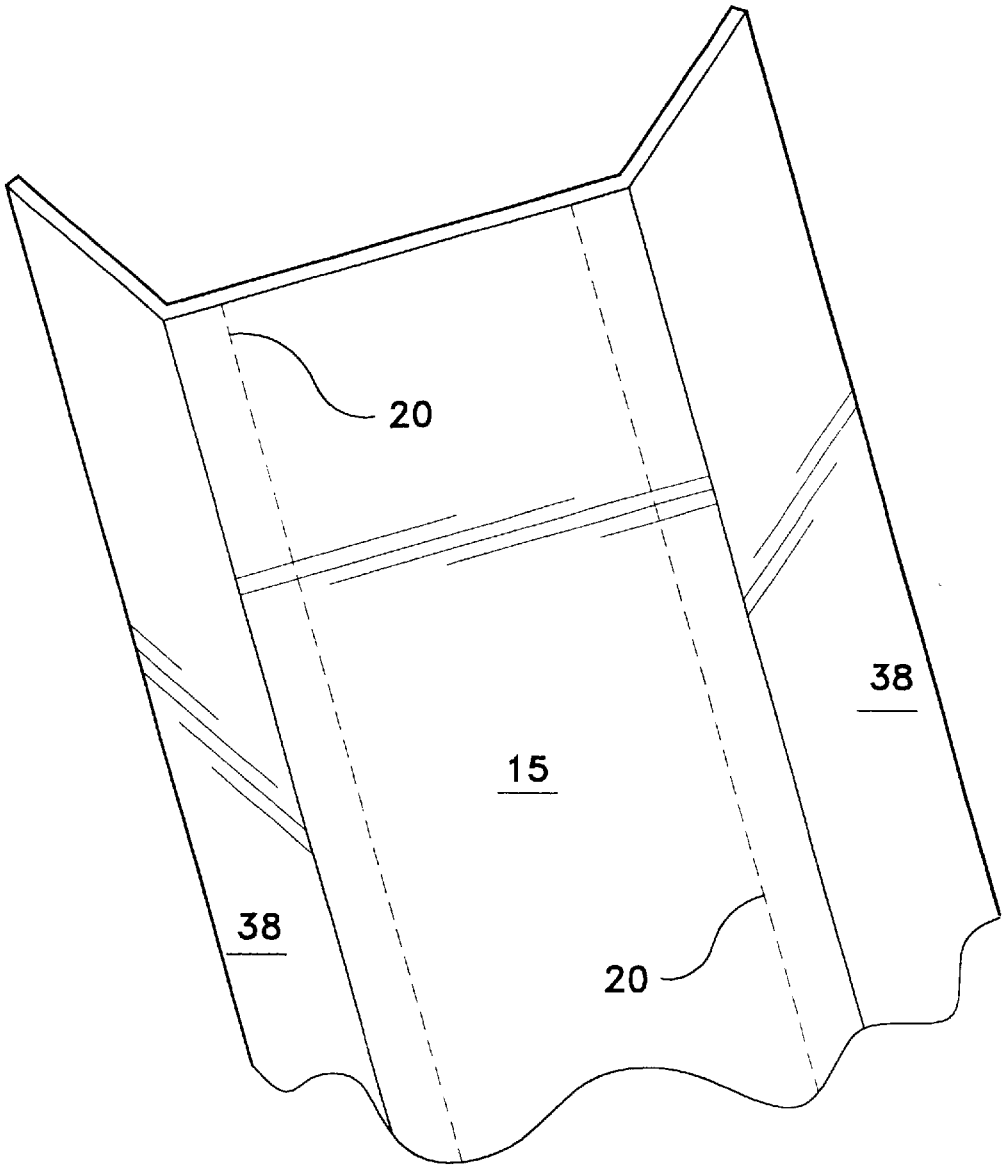
FIG. 4A is a top view of the sheet used to cover the top surface of the holder strip.
Figure 4B:
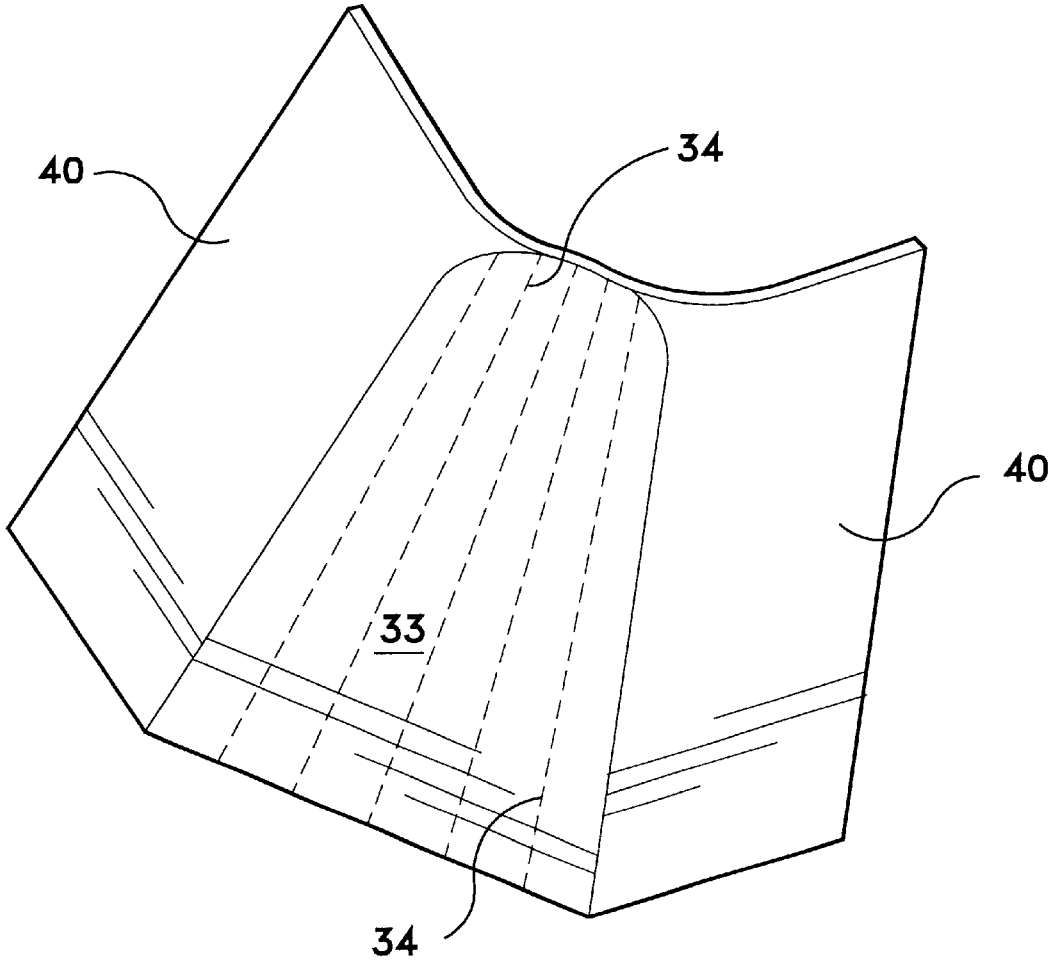
FIG. 4B is a top view of the sheet used to cover the top surface of the head strip.

FIGS. 4A, 4B show the sheets 15, 33 that overlie the top surface of the strips 14, 28. Each sheet 15, 33 has lines of perforations 20, 34 respectively, defined therein and are dimensioned to cover their respective strips. The perforations 20, on the holder strip sheet 15 function to allow the sheet to be easily removed once the strings are secured to a guitar. The perforations on the head strip sheet 33 function to allow one string at a time to be freed from the strip 28. The sheet 33 will ordinarily be secured to the head strip 28 with glue running, between the channels. Each sheet 15, 33 has flaps 38, 40 respectively, that overhang their respective strips and are secured to the back surface of their respective strips 12, 28.

Figure 5:
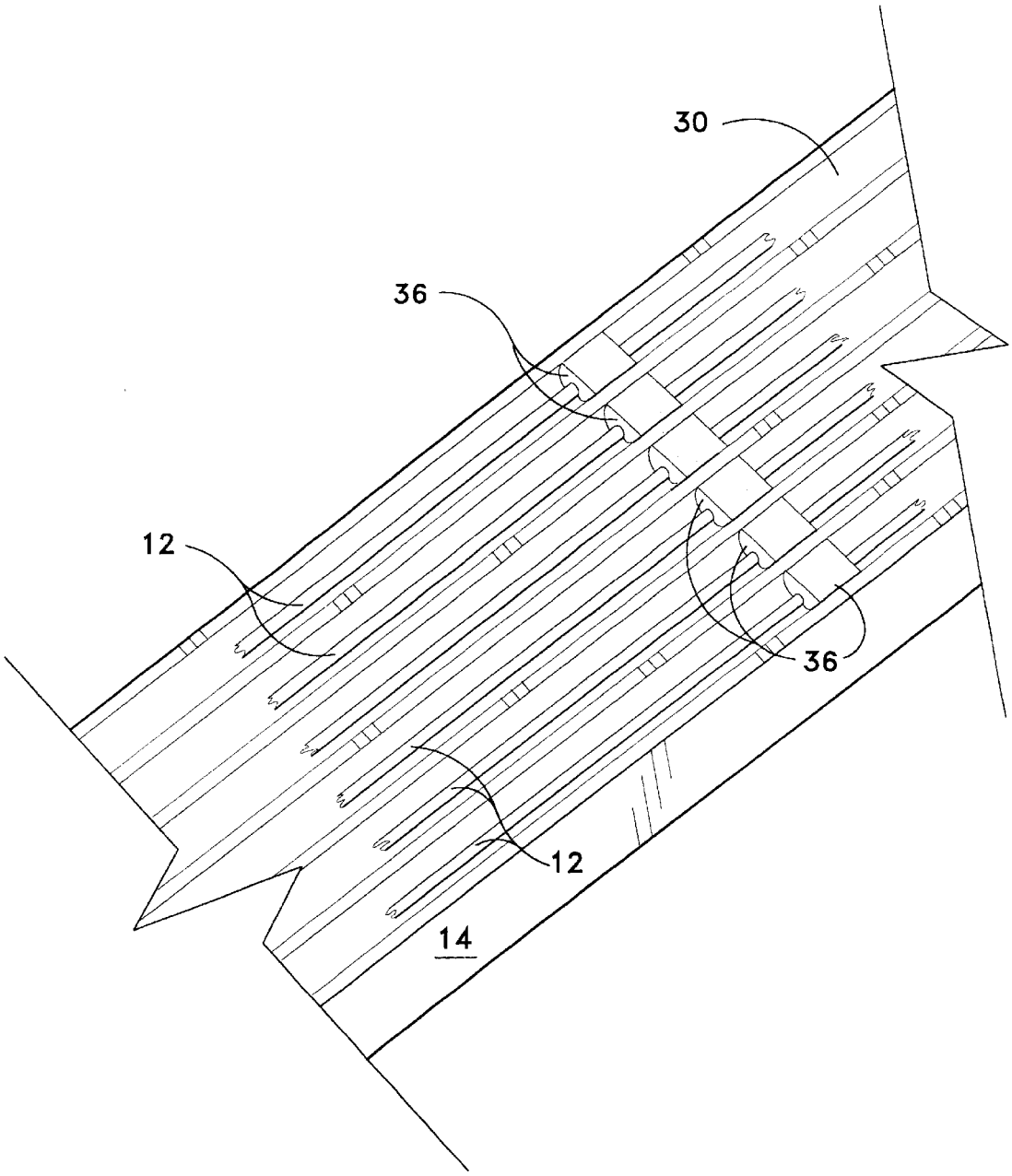
FIG. 5 is a top view of the holder strip using foam cylinders to secure instrument strings.

FIG. 5 details one manner of securing the strings 12 in the second type of channel 30. Foam semi-cylindrical blocks 36 are positioned under the sheets 15, 33 (not shown) on top of each string 12 to prevent unwanted movement of the strings 12.

Although the preferred embodiments of this invention have been correctly represented here, the inventor readily acknowledges that there are several other ways to package a set of strings, in order, on a holding strip without having any actual grooves formed into the holding strip itself. Any one of the aforementioned methods might prove quite suitable, and possibly more economical to produce. As an example: a simple flat holding strip of cardboard or plastic with very narrow strips of adhesive or double-adhesive tape running between and parallel to the strings. The adhesive would secure a clear plastic or paper cover-strip placed over the strings and would form a different and simpler type of "defined channel" between these adhesive strips wherein the strings would lie, hopefully without any adhesive touching them.

It is to be understood that the present invention is not limited to the embodiments described above, but encompasses any and all embodiments within the scope of the following claims.

I claim:

1. An easy install musical instrument string system, comprising:

a holder strip, substantially rectangular in shape, and having a front surface, a back surface, a top end, and a bottom end;

a plurality of channels defined along the front surface of said holder strip, and running from said top end to said bottom end;

a plurality of musical instrument strings having first and second ends each of said strings being disposed in each of said channels, said plurality of strings being arranged in an order adapted for replacement on a musical instrument, the first and second ends of said strings extending past the top end and the bottom end respectively, of said holder strip;

a sheet disposed upon the front surface of said holder strip, said sheet being dimensioned and configured for maintaining the strings within the channels;

a plurality of sheaths, one of said sheaths being disposed on the first end of each said strings, respectively; and a plurality of connection tabs, one of said tabs connecting each adjacent pair of said sheaths.

2. The easy install musical instrument string system according to claim 1, wherein said sheaths differ in length.

3. The easy install musical instrument string system according to claim 1, wherein said sheaths are dimensioned and configured to fit between tuning pegs of a guitar.

4. An easy install musical instrument string system further comprising:

a substantially rectangular holder strip having a front surface, a back surface, a top end and a bottom end;

plurality of first channels defined along the front surface of said holder strip and extending from the top end to the bottom end;

a plurality of musical instrument strings having first and second ends, each of said strings being disposed in each of said first channels, said plurality of strings being arranged in an order adapted for replacement on a musical instrument, the first and second ends of said strings extending past the top end and the bottom end, respectively, of said holder strip;

a first sheet disposed upon the front surface of said holder strip, said first sheet being dimensioned and configured for maintaining the strings within the first channels;

a generally triangular head strip having a front surface, a back surface, and a plurality of second channels defined in the front surface of said head strip; and a second sheet disposed upon the front surface of said head strip, the said second sheet having a plurality of perforation lines defined therein;

wherein the first ends of said strings are disposed in the second channels defined in said head strip.

5. The easy install musical instrument string system according to claim 1, wherein said holder strip is made a material selected from the group consisting of plastic, paper, cardboard, wood and metal.

6. An easy install musical instrument string system comprising:

a substantially rectangular holder strip having a front surface, back surface, atop end and a bottom end;

a plurality of channels defined along the front surface of said holder strip and extending from the top end to the bottom end;

a plurality of musical instrument strings having first and second ends, each of said strings being disposed in each of said channels, said plurality of strings being arranged in an order adapted for replacement on a musical instrument, the first and second ends of said strings extending past the top end and the bottom end, respectively, of said holder strip;

a sheet disposed upon the front surface of said holder strip said first sheet being dimensioned and configured for maintaining the strings within the channels;

a plurality of semi-cylindrical blocks positioned in each of said channels, above each of said strings and below said sheet.

7. The easy install musical instrument string system according to claim 6, wherein said semi-cylindrical blocks are made of a foam material.

8. The easy install musical instrument string system according to claim 4, wherein said holder strip is made from a material selected from the group consisting of plastic, paper, cardboard, wood and metal.

9. The easy install musical instrument string system according to claim 6, wherein said holder strip is made from a material selected from the group consisting of plastic, paper, cardboard, wood and metal.

* * * * *